US005386610A

United States Patent [19]

Batanjski

[11] Patent Number: 5,386,610

[45] Date of Patent: Feb. 7, 1995

[54] MULTIPLE ROLLER EDGER

[76] Inventor: Milorad Batanjski, 49250 Gratiot, Chesterfield, Mich. 48051

[21] Appl. No.: 69,516

[22] Filed: Jun. 1, 1993

[51] Int. Cl.[6] ..... B05C 17/02; B25G 1/04

[52] U.S. Cl. ..... 15/230.11; 15/210.1; 492/13

[58] Field of Search ..... 15/230.11, 230, 27, 15/209 R, 160, 166, 210 R, 246; 492/13, 14, 16; 38/100, 101

[56] References Cited

U.S. PATENT DOCUMENTS

| | | | |
|---|---|---|---|
| 1,927,962 | 9/1933 | Tamplin | 15/166 |
| 2,735,128 | 2/1956 | Adams | 492/13 |
| 2,837,757 | 6/1958 | Katanich | 15/166 |
| 3,130,435 | 4/1964 | Smith | 15/230.11 |
| 3,205,526 | 9/1965 | Archibald | 15/230.11 |
| 3,263,260 | 8/1966 | Filler | 15/230.11 |
| 3,346,899 | 10/1967 | Murphy | 15/230.11 |
| 3,408,626 | 11/1968 | Cayo | 15/230.11 |
| 3,409,929 | 11/1968 | Fisher | 15/230.11 |
| 3,790,984 | 2/1974 | Spransy et al. | 492/13 |
| 4,000,537 | 1/1977 | Woo | 15/230.11 |
| 4,198,723 | 4/1980 | Hiller et al. | 15/230.11 |
| 4,314,395 | 2/1982 | Brock | 15/230.11 |
| 4,320,553 | 3/1982 | Charles | 15/230.11 |
| 4,424,603 | 1/1984 | Balint et al. | 15/210.1 |

FOREIGN PATENT DOCUMENTS

| | | | |
|---|---|---|---|
| 1579501 | 7/1969 | France | 15/230.11 |
| 58222 | 3/1913 | Germany | 15/230.11 |

*Primary Examiner*—Timothy F. Simone
*Assistant Examiner*—Gary K. Graham
*Attorney, Agent, or Firm*—Basile and Hanlon

[57] ABSTRACT

A paint application device for painting a surface having an inside edge includes a handle, a paint application member and a guide member connected to the handle for guiding the paint application member with respect to an inside corner of the surface to be painted. Preferably, the guide member is extendible from the handle for an adjustable distance to adjustably set a desired distance between the inside corner and the paint application member. The guide member extends along an axis parallel to a longitudinal axis of the handle. A wing screw is provided for holding the guide member in a desired extended position. The guide member preferably has at least one roller engageable with the inside corner of the surface to be painted. The guide member is rotatable about an axis perpendicular to the longitudinal axis of the handle. A hinge tightening handle is provided to prevent rotational movement of the rotatable portion of the guide from a desired angular position. A shield is provided between the handle and the paint application member to protect against paint overspray.

2 Claims, 1 Drawing Sheet

MULTIPLE ROLLER EDGER

FIELD OF THE INVENTION

The present invention relates to a paint applicator for edging inside corners by guiding along the very edge of the inside corner or at an adjustable distance away from the inside corner.

BRIEF DESCRIPTION OF THE DRAWINGS

The present invention will become more apparent to those skilled in the art when the following description of the best mode contemplated for practicing the invention is read in conjunction with the accompanying drawings. The description herein makes reference to the accompanying drawings wherein like reference numerals refer to like parts throughout the several views, and wherein.

DESCRIPTION OF THE PREFERRED EMBODIMENT

Figure 5:
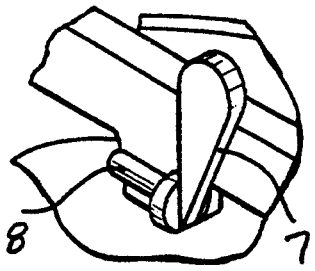
FIG. 5 is an exploded detailed view of a hinge and hinge tightening handle formed on a guide according to the present invention taken as shown from FIG. 1.
Figure 1:
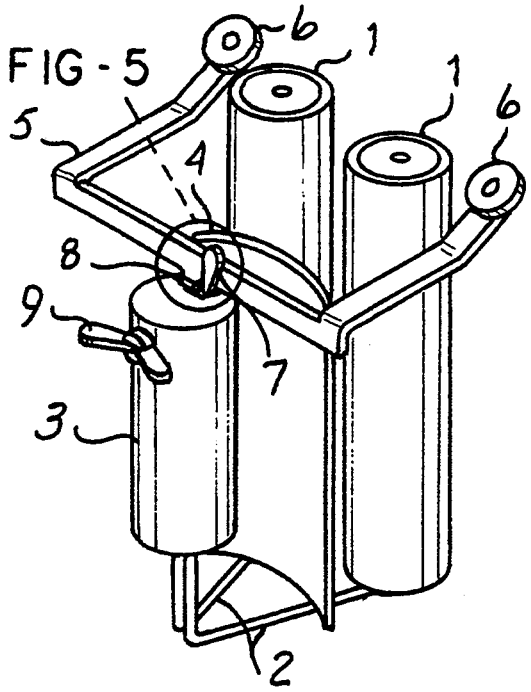
FIG. 1 is a perspective view of the paint application device according to the present invention.
Figure 2:
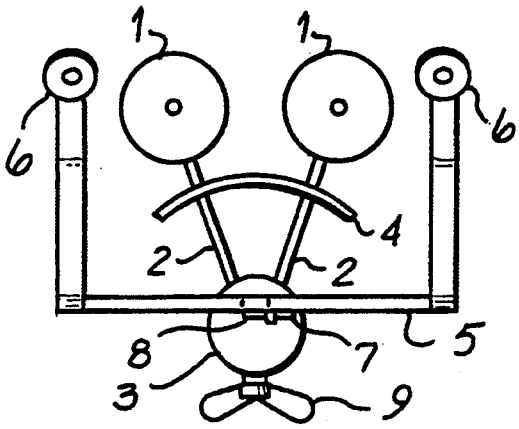
FIG. 2 is a top view of the paint application device when in the orientation as illustrated in FIG. 1.
Figure 3:
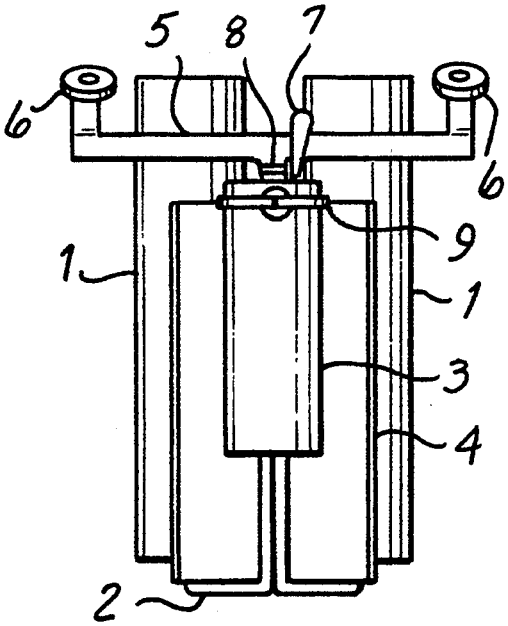
FIG. 3 is an elevational view of the paint application device when in the orientation as illustrated in FIG. 1.
Figure 4:
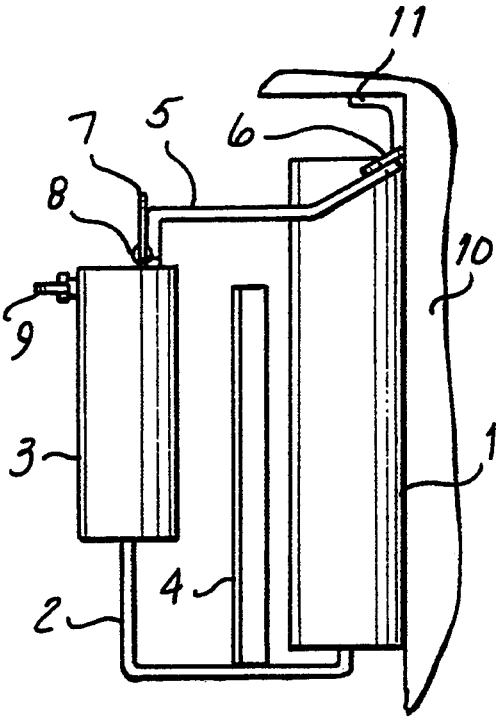
FIG. 4 is a side elevational view of the paint application device according to the present invention when in the orientation as shown in FIG. 1 and engaging an inside corner of a molding mounted in a corner of a wall.

The multiple roller edger as shown in FIG. 1 is a paint applicating device that consists of basically 9 main components, designed to ease, speed up and simplify the process of painting surfaces, by not having to be dipped in paint as often as a regular single roller. It is also a very precise tool for edging inside corners with great accuracy and speed by guiding the paint rollers with the guide wheels along the very edge of the corner or at an adjustable distance away from the inside corner.

The applicator roller 1 shows the paint applicating rollers that will turn around its axis as hand pressure is applied on handle 3 to left or right.

The main frame 2 is a main frame body of the device and is for the purpose of connecting the handle 3 to the rollers 1.

The handle 3 is for hand gripping and moving the whole device in any direction desired in order to achieve paint application on surfaces.

The hand shield 4 is a shield to protect one's hand from overspray of paint.

The guide 5 is a guide body which is adjustable in a way where it slides in or out of the handle 3 after wing screw 7 is loosened, therefore achieving the desired distance between the guide wheels 6 and rollers 1.

The guide wheels 6 roll along the inside corner as the whole device is pushed to left or right.

The hinge tightening handle 7 is made to loosen the hinge in the guide frame body so it can be adjusted up or down and tighten the same hinge 8 so it does not move.

The hinge 8 is in the guide body for up or down adjustments of the guide wheels.

The wing screw 9 is loosened by hand in order to slide guide body 5 in or out of handle 3 and hand tighten in order to hold guide body 5 in one position.

The multiple roller edger is a hand operated device that will apply paint onto surfaces faster and more even, and does not have to be dipped into paint as often as a single roller.

The multiple roller edger is exceptionally easy and simple to handle and operate, being that it is a freestanding device and does not need balancing by human hand or wrist, except for pressure sideways to achieve motion and therefore paint application.

The multiple roller edger is simple to dip into paint by having paint in a paint tray.

The multiple roller edger is extremely precise for edging off with paint, the unpainted edges of inside corners of walls and ceilings with the aid of guide wheels, therefore saving time and effort as compared to any brush, roller, or other device.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A paint applicator for painting a surface having an inside edge comprising:

an elongated handle having a longitudinal axis;

at least two paint applicator rollers having axes of rotation disposed parallel to one another and parallel to said longitudinal axis of said handle, said paint applicator rollers connected to and support from said handle;

guide means adjustably connected to said handle for guiding said paint applicator rollers with respect to said inside edge of said surface, said guide means extendible along an axis parallel to said longitudinal axis of said handle to adjustably set a desired distance between said inside edge and said paint applicator rollers, said guide means having at least two rollers engageable with said inside edge and spaced from one another on opposite sides of said two paint applicator rollers, said guide means rotatable about a hinge having an axis perpendicular to said longitudinal axis of said handle;

means for tightening said hinge to prevent rotational movement of said guide means from a desired angular position;

means for holding said guide means in a desired extended position; and a shield between said handle and said at least two paint applicator rollers to protect against paint overspray.

2. The paint applicator of claim 1 wherein said guide means further comprises:

an elongated guide body extendible from within said elongated handle; and a guide frame pivotally connected to said guide body about said hinge axis perpendicular to said longitudinal axis, said guide frame supporting said rollers in spaced relationship to one another.

* * * * *